US006609337B1

(12) United States Patent
O'Connell

(10) Patent No.: US 6,609,337 B1
(45) Date of Patent: Aug. 26, 2003

(54) TILE FOR A PITCHED ROOF

(76) Inventor: Rosemary T. O'Connell, P.O. Box 354, Centerport, NY (US) 11721

( * ) Notice: Subject to any disclaimer, the term of this patent is extended or adjusted under 35 U.S.C. 154(b) by 20 days.

(21) Appl. No.: 09/925,515

(22) Filed: Aug. 9, 2001

(51) Int. Cl.[7] ..... E04H 9/16

(52) U.S. Cl. ..... 52/101; 52/520; 52/541; 52/560

(58) Field of Search ..... 52/101, 519, 520, 52/521, 543, 560, 536, 541, 552, 556

(56) References Cited

U.S. PATENT DOCUMENTS

| | | | | |
|---|---|---|---|---|
| 4,343,866 A | | 8/1982 | Oser et al. | 428/593 |
| 4,611,451 A | | 9/1986 | Symbold | 52/555 |
| 5,343,664 A | * | 9/1994 | Loucks | 52/518 |
| 5,440,855 A | | 8/1995 | Loucks | 52/518 |
| 5,502,940 A | * | 4/1996 | Fifield | 52/309.12 |
| 5,526,626 A | | 6/1996 | Loucks | 52/518 |

FOREIGN PATENT DOCUMENTS

| | | | | |
|---|---|---|---|---|
| DE | 3535737 A1 | * | 4/1987 | 52/309.12 |

* cited by examiner

*Primary Examiner*—Carl D. Friedman
*Assistant Examiner*—Naoko Slack
(74) *Attorney, Agent, or Firm*—Richard L. Miller

(57) ABSTRACT

A tile for a pitched roof. The tile includes a body that overlies the pitched roof and a plurality of protrusions that stick outwardly from the body and function as heat sinks that sluff-off heat and impede thermal energy from being transmitted to the pitched roof. The body includes a lower portion that is made of a thermal insulating material and an upper portion that is a metallic plate. The metallic plate extends past the lower portion of the body so as to form an overhang that defines an undercut. The undercut of one tile receives a portion of a next lowest tile, and in so doing, interlocks the one tile and the next lowest tile, and in so doing, allows the metallic plate of the one tile to directly contact, and be continuous with, the metallic plate of the next lowest tile for improved heat transfer.

33 Claims, 1 Drawing Sheet

TILE FOR A PITCHED ROOF

BACKGROUND OF THE INVENTION

1. Field of the Invention

The present invention relates to a tile. More particularly, the present invention relates to a tile for a pitched roof.

2. Description of the Prior Art

Numerous innovations for roof coverings have been provided in the prior art that will be described. Even though these innovations may be suitable for the specific individual purposes to which they address, however, they differ from the present invention.

A FIRST EXAMPLE, U.S. Pat. No. 4,343,866 to Oser et al. teaches a method of deep embossing sheet material, generally metal. A small scale relief pattern is first embossed across the entire sheet and thereafter a deep embossment of spaced-apart protuberances is imparted to the sheet. Both patterns in combination produce a sheet useful for reflective thermal insulation without the risk of significantly puncturing the sheet.

A SECOND EXAMPLE, U.S. Pat. No. 4,611,451 to Symbold teaches a shingle formed from a sheet of thin metal such as aluminum having a narrow border portion and a plurality of strips of various lengths depending from the border. The shingles are attached to a roof by nailing through the border portion such that the strips overlap the border portions of adjacent shingles thereby producing a simulation of a natural thatched roof.

A THIRD EXAMPLE, U.S. Pat. No. 5,343,664 to Loucks teaches roofing components and method for pitched roofs that includes a flexible base and one or more ranks of integrally formed thin blades, vanes or fins extending outwardly from the base. The blades, fins or vanes are spaced substantially parallel to each other and overlap to shadow lower elements and to provide air circulation and between blades, which are designed to sluff-off heat and impede thermal energy being transmitted to the roof. The blades, fins or vanes are flexible and resilient so as to absorb the impact of falling material (limbs, etc.). One edge portion of the base is free of blades to provide an overlapped area for installation on a pitched roof. Various overlapping and interlocking arrangements are disclosed for sealing purposes.

A FOURTH EXAMPLE, U.S. Pat. No. 5,440,855 to Loucks teaches roofing components and method for pitched roofs that includes a flexible base and one or more ranks of integrally formed thin blades, vanes or fins extending outwardly from the base. The blades, fins or vanes are spaced substantially parallel to each other and overlap to shadow lower elements and to provide air circulation and between blades, which are designed to sluff-off heat and impede thermal energy being transmitted to the roof. The blades, fins or vanes are flexible and resilient so as to absorb the impact of falling material (limbs, etc.). One edge portion of the base is free of blades to provide an overlapped area for installation on a pitched roof. Various overlapping and interlocking arrangements are disclosed for sealing purposes.

A FIFTH EXAMPLE, U.S. Pat. No. 5,526,626 to Loucks teaches roofing components and method for pitched roofs that includes a flexible base and one or more ranks of integrally formed thin blades, vanes or fins extending outwardly from the base. The blades, fins or vanes are spaced substantially parallel to each other and overlap to shadow lower elements and to provide air circulation and between blades, which are designed to sluff-off heat and impede thermal energy being transmitted to the roof. The blades, fins or vanes are flexible and resilient so as to absorb the impact of falling material (limbs, etc.). One edge portion of the base is free of blades to provide an overlapped area for installation on a pitched roof. Various overlapping and interlocking arrangements are disclosed for sealing purposes.

It is apparent that numerous innovations for roof coverings have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a tile for a pitched roof that avoids the disadvantages of the prior art.

ANOTHER OBJECT of the present invention is to provide a tile for a pitched roof that is simple and inexpensive to manufacture.

STILL ANOTHER OBJECT of the present invention is to provide a tile for a pitched roof that is simple to use.

BRIEFLY STATED, STILL YET ANOTHER OBJECT of the present invention is to provide a tile for a pitched roof. The tile includes a body that overlies the pitched roof and a plurality of protrusions that stick outwardly from the body and function as heat sinks that sluff-off heat and impede thermal energy from being transmitted to the pitched roof. The body includes a lower portion that is made of a thermal insulating material and an upper portion that is a metallic plate. The metallic plate extends past the lower portion of the body so as to form an overhang that defines an undercut. The undercut of one tile receives a portion of a next lowest tile, and in so doing, interlocks the one tile and the next lowest tile, and in so doing, allows the metallic plate of the one tile to directly contact, and be continuous with, the metallic plate of the next lowest tile for improved heat transfer.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

First Embodiment

Figure 1:
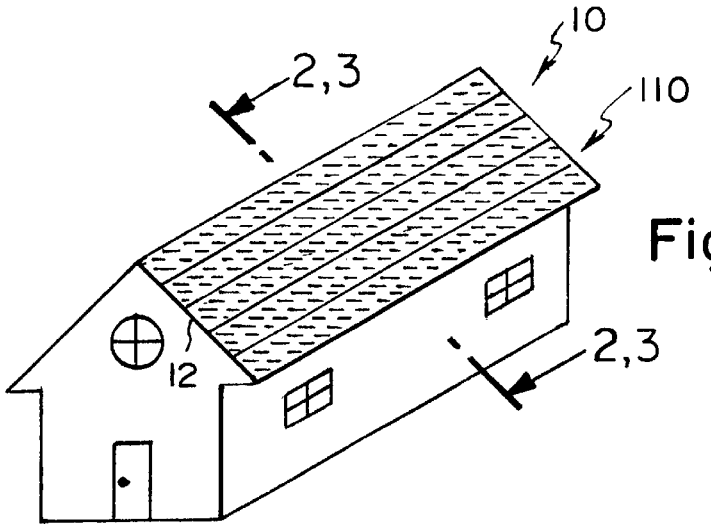
FIG. 1 is a diagrammatic perspective view of the present invention in use.

10 tile of present invention for pitched roof 12
12 pitched roof

14 body for directly overlying pitched roof.
16 plurality of protrusions for sluffing-off heat and impeding thermal energy from being transmitted to pitched roof 12, while preventing birds from perching on pitched roof 12
18 lower portion of body 14 for directly overlying, and completely contacting, pitched roof 12
20 upper portion of body 14
22 innermost surface of lower portion 18 of body 14 for directly contacting pitched roof 12
24 lowermost edge of innermost surface 22 of lower portion 18 of body 14
26 uppermost edge of innermost surface 22 of lower portion 18 of body 14
28 lowermost surface of lower portion 18 of body 14
30 terminal edge of lowermost surface 28 of lower portion 18 of body 14
32 uppermost surface of lower portion 18 of body 14
34 terminal edge of uppermost surface 32 of lower portion 18 of body 14
36 outermost surface of lower portion 18 of body 14
38 plate of upper portion 20 of body 14
40 innermost surface of plate 38 of upper portion 20 of body 14
42 outermost surface of plate 38 of upper portion 20 of body 14
44 uppermost edge of plate 38 of upper portion 20 of body 14
46 lowermost edge of plate 38 of upper portion 20 of body 14
47 uppermost portion of body 14 for attaching to pitched roof 12
48 overhang of plate 38 of upper portion 20 of body 14
49 conventional roofing nails
50 undercut of body 14
51 throughbores in uppermost portion 47 of body 14
52 innermost end of each protrusion of plurality of protrusions 16
53 outermost end of each protrusion of plurality of protrusions 16 for dissipating heat
54 foot on innermost end 52 of each protrusion of plurality of protrusions 16
56 weld of each protrusion of plurality of protrusions 16

Second Embodiment

110 tile of present invention for pitched roof 12
114 body
118 lower portion of body 114
122 innermost surface of lower portion 118 of body 114
124 lowermost edge of innermost surface 122 of lower portion 118 of body 114
128 lowermost surface of lower portion 118 of body 114
132 uppermost surface of lower portion 118 of body 114
146 lowermost edge of plate 138
158 first surface of lowermost surface 128 of lower portion 118 of body 114
160 terminal edge of first surface 158 of lowermost surface 128 of lower portion 118 of body 114
162 second surface of lowermost surface 128 of lower portion 118 of body 114
164 terminal edge of second surface 162 of lowermost surface 128 of lower portion 118 of body 114
166 third surface of lowermost surface 128 of lower portion 118 of body 114

DESCRIPTION OF THE PREFERRED EMBODIMENT

Referring now to the figures, in which like numerals indicate like parts, and particularly to FIG. 1, the tile of the present invention is shown generally at 10, 110 for a pitched roof 12.

Figure 2:
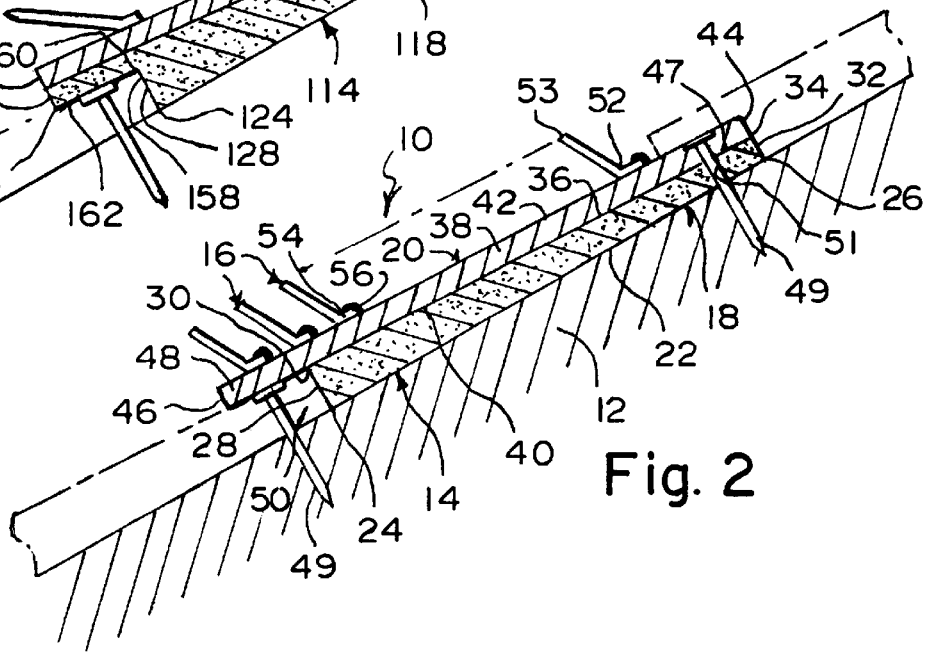
FIG. 2 is an enlarged diagrammatic cross sectional view taken on line 2—2 in FIG. 1 of a first embodiment of the present invention.

A first embodiment of the tile 10 can best be seen in FIG. 2, and as such, will be discussed with reference thereto.

The tile 10 comprises a body 14 that has a complete length and is for directly overlying the pitched roof 12.

The tile 10 further comprises a plurality of protrusions 16 that stick directly outwardly from the body 14 and function as heat sinks for sluffing-off heat and impeding thermal energy from being transmitted to the pitched roof 12, while preventing birds from perching on the pitched roof 12.

The body 14 comprises a lower portion 18 for directly overlying, and completely contacting, the pitched roof 12.

The body 14 further comprises an upper portion 20 that directly overlies, and is attached to, the lower portion 18 of the body 14.

The body 14 further comprises a bonding agent that attaches the upper portion 20 of the body 14 to the lower portion 18 of the body 14.

The lower portion 18 of the body 14 is made of thermal insulating material.

The thermal insulating material of which the lower portion 18 of the body 14 is made of is foam.

The lower portion 18 of the body 14 has an innermost surface 22 that is flat and is for directly contacting the pitched roof 12.

The innermost surface 22 of the lower portion 18 of the body 14 has a lowermost edge 24, an uppermost edge 26, and a width.

The lower portion 18 of the body 14 further has a lowermost surface 28 that extends outwardly from the lowermost edge 24 of the innermost surface 22 of the lower portion 18 of the body 14, to a terminal edge 30 thereof, and has a height.

The height of the lowermost surface 28 of the lower portion 18 of the body 14 is much less than the width of the innermost surface 22 of the lower portion 18 of the body 14, and as a result thereof, prevents the body 14 from projecting too far from the pitched roof 12.

The lower portion 18 of the body 14 further has an uppermost surface 32 that is flat and extends perpendicularly outwardly from the uppermost edge 26 of the innermost surface 22 of the lower portion 18 of the body 14, to a terminal edge 34 thereof, and has a height.

The lower portion 18 of the body 14 further has an outermost surface 36 that is flat and extends from the terminal edge 30 of the lowermost surface 28 of the lower portion 18 of the body 14, to the terminal edge 34 of the uppermost surface 32 of the lower portion 18 of the body 14.

The height of the uppermost surface 32 of the lower portion 18 of the body 14 is less than the height of the lowermost surface 28 of the lower portion 18 of the body 14 so as to allow the outermost surface 36 of the lower portion 18 of the body 14 to pitch downwardly and outwardly relative to the pitched roof 12.

The lowermost surface 28 of the lower portion 18 of the body 14 is flat and extends perpendicularly outwardly from the lowermost edge 24 of the innermost surface 22 of the lower portion 18 of the body 14.

The uppermost surface 32 of the lower portion 18 of the body 14 is parallel to the lowermost surface 28 of the lower portion 18 of the body 14.

The upper portion 20 of the body 14 is a plate 38.

The plate 38 is thin, flat, and rectilinear.

The plate 38 is metallic.

The plate 38 has a color.

The plate 38 has an innermost surface 40, an outermost surface 42 with a complete area, an uppermost edge 44, and a lowermost edge 46.

The innermost surface 40 of the plate 38 directly overlies, and is attached to, the outermost surface 36 of the lower portion 18 of the body 14.

The uppermost edge 44 of the plate 38 is coplanar with the uppermost surface of the lower portion 18 of the body 14 and forms therewith an uppermost portion 47 of the body 14 for attaching to the pitched roof 12 by conventional roofing nails 49, in so doing, creates throughbores 51 in the uppermost portion 47 of the body 14.

The lowermost edge 46 of the plate 38 extends past the lowermost surface 28 of the lower portion 18 of the body 14 so as to form an overhang 48.

The overhang 48 of the body 14 extends along the complete length of the body 14.

The overhang 48 of the body 14 together with the lowermost surface 28 of the lower portion 18 of the body 14 define an undercut 50.

The undercut 50 of the body 14 extends along the complete length of the body 14.

The undercut 50 of the body 14 of one tile 10 receives, and is completely filled by, the uppermost portion 47 of the body 14 of a next lowest tile 10, and in so doing, completely interlocks the one tile 10 and the next lowest tile 10 together, and in so doing, allows the plate 38 of the one tile to directly contact, and be continuous with, the plate 38 of the next lowest tile 10 for improved heat transfer, while the overhang 48 of the one tile 10 covers the conventional roofing nails 49 holding the next lowest tile 10 to the pitched roof 12, and in so doing, shields and protects against weather entering the throughbores 51 in the uppermost portion 47 of the body 14 created by the conventional roofing nails 49.

The plurality of protrusions 16 stick directly outwardly and downwardly from the outermost surface 42 of the plate 38, at an acute angle relative thereto.

The plurality of protrusions 16 are parallel to each other.

The plurality of protrusions 16 are spaced-apart from each other over the complete area of the outermost surface 42 of the plate 38 so as to provide complete coverage of the outermost surface 42 of the plate 38 therewith.

The plurality of protrusions 16 have a color.

The color of the plurality of protrusions 16 matches the color of the plate 38 so as to form a same color for the pitched roof 12.

The plurality of protrusions 16 are slender and elongated.

The plurality of protrusions 16 are resilient.

The plurality of protrusions 16 are pins.

The plurality of protrusions 16 are hairs.

The plurality of protrusions 16 are spikes.

The plurality of protrusions 16 are fibers.

The plurality of protrusions 16 are metallic.

Each protrusion 16 has an innermost end 52 and an outermost end 53 that is free for dissipating the heat.

The innermost end 52 of each protrusion 16 has a foot 54 thereon that is attached to the outermost surface 42 of the plate 38.

Each protrusion 16 further has a weld 56 that attaches the foot 54 of each protrusion 16 to the outermost surface 42 of the plate 38.

Figure 3:
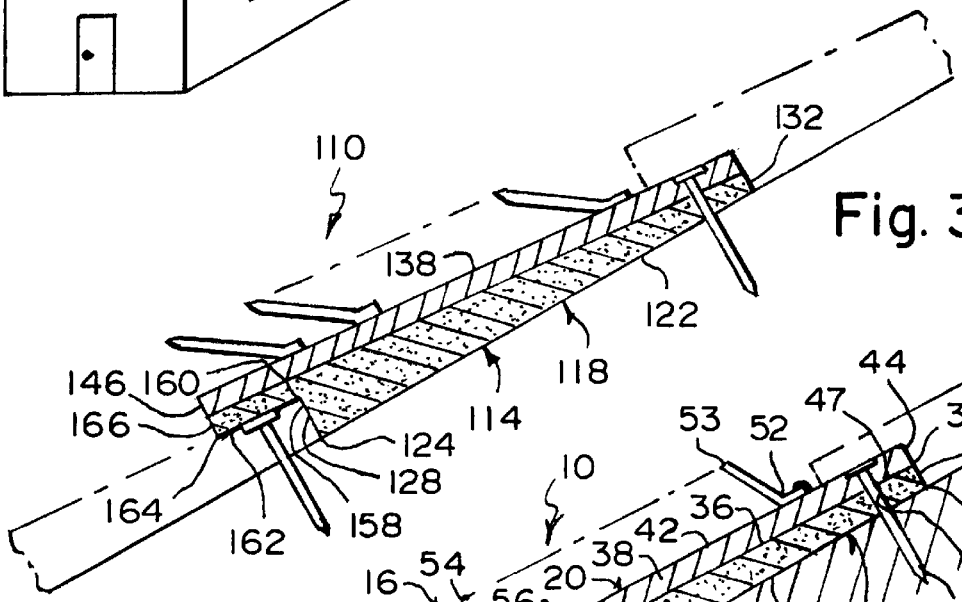
FIG. 3 is an enlarged diagrammatic cross sectional view taken on line 3—3 in FIG. 1 of a second embodiment of the present invention.

A second embodiment of the tile 110 can best be seen in FIG. 3, and as such, will be discussed with reference thereto.

The tile 110 is similar to the tile 10, except that:

1. The lowermost surface 128 of the lower portion 118 of the body 114 has a first surface 158 that is flat and extends perpendicularly outwardly from the lowermost edge 124 of the innermost surface 122 of the lower portion 118 of the body 114, to a terminal edge 160.
2. The first surface 158 of the lowermost surface 128 of the lower portion 118 of the body 114 is parallel to the uppermost surface 132 of the lower portion 118 of the body 114.
3. The lowermost surface 128 of the lower portion 118 of the body 114 further has a second surface 162 that is flat and extends perpendicularly downwardly from the terminal edge 160 of the first surface 158 of the lowermost surface 128 of the lower portion 118 of the body 114, to a terminal edge 164.
4. The second surface 162 of the lowermost surface 128 of the lower portion 118 of the body 114 is parallel to the plate 138.
5. The lowermost surface 128 of the lower portion 118 of the body 114 further has a third surface 166 that is flat and extends perpendicularly outwardly from the terminal edge 164 of the second surface 162 of the lowermost surface 128 of the lower portion 118 of the body 114, and therewith, supplements the overhang of the plate 138, and in so doing, prevents the plate 138 of the one tile 110 from directly contacting the plate 138 of the next lowest tile 110 so as to allow the plate 138 of the one tile 110 to be spaced-apart from, and discontinuous with, the plate 138 of the next lowest tile 110 for improved RF reception.
6. The third surface 166 of the lowermost surface 128 of the lower portion 118 of the body 114 is parallel to the first surface 158 of the lowermost surface 128 of the lower portion 118 of the body 114.
7. The third surface 166 of the lowermost surface 128 of the lower portion 118 of the body 114 is coplanar with the lowermost edge 146 of the plate 138.

It will be understood that each of the elements described above, or two or more together, may also find a useful application in other types of constructions differing from the types described above.

While the invention has been illustrated and described as embodied in a tile for a pitched roof, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A tile for a pitched roof, comprising:

a) a body; and b) a plurality of protrusions sticking directly outwardly from said body;

wherein said body has a complete length;

wherein said body is for directly overlying the pitched roof;

wherein said plurality of protrusions function as heat sinks for sluffing-off heat and impeding thermal energy from being transmitted to the pitched roof;

wherein said plurality of protrusions is for preventing birds from perching on the pitched roof;
wherein said body comprises a lower portion;
wherein said lower portion of said body is for directly overlying the pitched roof;
wherein said lower portion of said body is for completely contacting the pitched roof;
wherein said body further comprises an upper portion;
wherein said upper portion of said body directly overlies said lower portion of said body;
wherein said upper portion of said body is attached to said lower portion of said body;
wherein said lower portion of said body has an innermost surface;
wherein said innermost surface of said lower portion of said body is flat;
wherein said innermost surface of said lower portion of said body is for directly contacting the pitched roof;
wherein said innermost surface of said lower portion of said body further has a lowermost edge;
wherein said innermost surface of said lower portion of said body further has an uppermost edge;
wherein said innermost surface of said lower portion of said body further has a width;
wherein said lower portion of said body further has a lowermost surface;
wherein said lowermost surface of said lower portion of said body extends outwardly from said lowermost edge of said innermost surface of said lower portion of said body, to a terminal edge thereof;
wherein said lowermost surface of said lower portion of said body has a height;
wherein said lower portion of said body further has an uppermost surface;
wherein said uppermost surface of said lower portion of said body is flat;
wherein said uppermost surface of said lower portion of said body extends perpendicularly outwardly from said uppermost edge of said innermost surface of said lower portion of said body, to a terminal edge thereof;
wherein said uppermost surface of said lower portion of said body has a height;
wherein said lower portion of said body further has an outermost surface;
wherein said outermost surface of said lower portion of said body is flat;
wherein said outermost surface of said lower portion of said body extends from said terminal edge of said lowermost surface of said lower portion of said body, to said terminal edge of said uppermost surface of said lower portion of said body;
wherein said upper portion of said body is a plate;
wherein said plate has an innermost surface;
wherein said plate further has an outermost surface;
wherein said outermost surface of said plate has a complete area;
wherein said plate further has an uppermost edge;
wherein said plate further has a lowermost edge;
said uppermost edge of said plate is coplanar with said uppermost surface of said lower portion of said body;
wherein said uppermost edge of said plate and said uppermost surface of said lower portion of said body form an uppermost portion of said body;
wherein said uppermost portion of said body is for attaching to the pitched roof by conventional roofing nails, in so doing, creates throughbores in said uppermost portion of said body;
wherein said lowermost edge of said plate extends past said lowermost surface of said lower portion of said body so as to form an overhang;
wherein said overhang of said body together with said lowermost surface of said lower portion of said body define an undercut;
wherein said undercut of said body of one tile receives, and is completely filled by, said uppermost portion of said body of a next lowest tile, and in so doing, completely interlocks said one tile and said next lowest tile, and in so doing, allows said plate of said one tile to directly contact, and be continuous with, said plate of said next lowest tile for improved heat transfer, while said overhang of said one tile covers the conventional roofing nails holding said next lowest tile to the pitched roof, and in so doing, shields and protects against weather entering said throughbores in said uppermost portion of said body created by the conventional roofing nails;
wherein each protrusion has an innermost end;
wherein each protrusion further has an outermost end;
wherein said outermost end of each protrusion is free for dissipating the heat;
wherein said innermost end of each protrusion has a foot thereon; wherein said foot of each protrusion is attached to said outermost surface of said plate;
wherein each protrusion further has a weld; and
wherein said weld of each protrusion attaches said foot of each protrusion to said outermost surface of said plate.

2. The tile as defined in claim 1, wherein said body further comprises a bonding agent; and wherein said bonding agent of said body attaches said upper portion of said body to said lower portion of said body.

3. The tile as defined in claim 1, wherein said lower portion of said body is made of thermal insulating material.

4. The tile as defined in claim 3, wherein said thermal insulating material of which said lower portion of said body is made of is foam.

5. The tile as defined in claim 1, wherein said height of said lowermost surface of said lower portion of said body is much less than said width of said innermost surface of said lower portion of said body, and as a result thereof, prevents said body from projecting too far from the pitched roof.

6. The tile as defined in claim 1, wherein said height of said uppermost surface of said lower portion of said body is less than said height of said lowermost surface of said lower portion of said body so as to allow said outermost surface of said lower portion of said body to pitch downwardly and outwardly relative to the pitched roof.

7. The tile as defined in claim 1, wherein said plate is thin;
wherein said plate is flat; and
wherein said plate is rectilinear.

8. The tile as defined in claim 1, wherein said plate is metallic.

9. The tile as defined in claim 1, wherein said plate has a color.

10. The tile as defined in claim 9, wherein said plurality of protrusions have a color.

11. The tile as defined in claim 10, wherein said color of said plurality of protrusions matches said color of said plate so as to form a same color for the pitched roof.

12. The tile as defined in claim 1, wherein said innermost surface of said plate directly overlies said outermost surface of said lower portion of said body;

wherein said innermost surface of said plate is attached to said outermost surface of said lower portion of said body.

13. The tile as defined in claim 1, wherein said overhang of said body extends along said complete length of said body.

14. The tile as defined in claim 1, wherein said undercut of said body extends along said complete length of said body.

15. The tile as defined in claim 1, wherein said plurality of protrusions stick directly outwardly and downwardly from said outermost surface of said plate, at an acute angle relative thereto.

16. The tile as defined in claim 1, wherein said plurality of protrusions are parallel to each other.

17. The tile as defined in claim 1, wherein said plurality of protrusions are spaced-apart from each over said complete area of said outermost surface of said plate so as to provide complete coverage of said outermost surface of said plate therewith.

18. The tile as defined in claim 1, wherein said plurality of protrusions are slender; and wherein said plurality of protrusions are elongated.

19. The tile as defined in claim 1, wherein said plurality of protrusions are resilient.

20. The tile as defined in claim 1, wherein said plurality of protrusions are pins.

21. The tile as defined in claim 1, wherein said plurality of protrusions are hairs.

22. The tile as defined in claim 1, wherein said plurality of protrusions are spikes.

23. The tile as defined in claim 1, wherein said plurality of protrusions are fibers.

24. The tile as defined in claim 1, wherein said plurality of protrusions are metallic.

25. The tile as defined in claim 1, wherein said lowermost surface of said lower portion of said body is flat; and wherein said lowermost surface of said lower portion of said body extends perpendicularly outwardly from said lowermost edge of said innermost surface of said lower portion of said body.

26. The tile as defined in claim 1, wherein said uppermost surface of said lower portion of said body is parallel to said lowermost surface of said lower portion of said body.

27. The tile as defined in claim 1, wherein said lowermost surface of said lower portion of said body has a first surface;

wherein said first surface of said lowermost surface of said lower portion of said body is flat; and wherein said first surface of said lowermost surface of said lower portion of said body extends perpendicularly outwardly from said lowermost edge of said innermost surface of said lower portion of said body, to a terminal edge.

28. The tile as defined in claim 27, wherein said first surface of said lowermost surface of said lower portion of said body is parallel to said uppermost surface of said lower portion of said body.

29. The tile as defined in claim 27, wherein said lowermost surface of said lower portion of said body further has a second surface;

wherein said second surface of said lowermost surface of said lower portion of said body is flat; and wherein said second surface of said lowermost surface of said lower portion of said body extends perpendicularly downwardly from said terminal edge of said first surface of said lowermost surface of said lower portion of said body, to a terminal edge.

30. The tile as defined in claim 29, wherein said second surface of said lowermost surface of said lower portion of said body is parallel to said plate.

31. The tile as defined in claim 29, wherein said lowermost surface of said lower portion of said body further has a third surface;

wherein said third surface of said lowermost surface of said lower portion of said body is flat;

wherein said third surface of said lowermost surface of said lower portion of said body extends perpendicularly outwardly from said terminal edge of said second surface of said lowermost surface of said lower portion of said body; and wherein said third surface of said lowermost surface of said lower portion of said body and said second surface of said lowermost surface of said lower portion of said body supplement said overhang of said plate, and in so doing, prevents said plate of one tile from directly contacting said plate of a next lowest tile so as to allow said plate of said one tile to be spaced-apart from, and discontinuous with, said plate of said next lowest tile for improved RF reception.

32. The tile as defined in claim 31, wherein said third surface of said lowermost surface of said lower portion of said body is parallel to said first surface of said lowermost surface of said lower portion of said body.

33. The tile as defined in claim 31, wherein said third surface of said lowermost surface of said lower portion of said body is coplanar with said lowermost edge of said plate.

* * * * *